US008261636B2

(12) United States Patent
Lin

(10) Patent No.: US 8,261,636 B2
(45) Date of Patent: Sep. 11, 2012

(54) QUICK-TURN WRENCH

(75) Inventor: Chun-Lang Lin, Taichung (TW)

(73) Assignee: Advance Team Power Inc., Taichung (TW)

( * ) Notice: Subject to any disclaimer, the term of this patent is extended or adjusted under 35 U.S.C. 154(b) by 110 days.

(21) Appl. No.: 13/011,051

(22) Filed: Jan. 21, 2011

(65) Prior Publication Data

US 2011/0232426 A1 Sep. 29, 2011

(30) Foreign Application Priority Data

Mar. 24, 2010 (TW) ..... 99108796 A

(51) Int. Cl.
*B25B 13/46* (2006.01)

(52) U.S. Cl. ..... 81/63.1; 81/62; 81/60; 192/43; 192/43.1; 192/43.2; 192/44

(58) Field of Classification Search ..... 81/58–63.2, 81/429–462, 467–483; 192/43–44
See application file for complete search history.

(56) References Cited

U.S. PATENT DOCUMENTS 743,942 A * 11/1903 Sinclair ..... 81/62
6,993,998 B1 * 2/2006 Kao et al. ..... 81/60

* cited by examiner

*Primary Examiner* — Monica Carter
*Assistant Examiner* — Melanie Alexander
(74) *Attorney, Agent, or Firm* — Wang Law Firm, Inc.; Li K. Wang

(57) ABSTRACT

A quick-turn wrench includes a driving head with an axle hole. One side of the axle hole has a claw. A ratchet ring is accommodated in the axle hole. One end of the ratchet ring extends outside the axle hole and connects to a wrench handle. The ratchet ring is surrounded by a ratchet part that correspondingly engages the claw. A transmission rod is inserted into the ratchet ring, with one end having a transmission part. A bottom plate is disposed at the bottom of the axle hole. The end surface of the bottom plate facing the axle hole has a sliding groove. A pushing element is disposed in the sliding groove corresponding to the claw. The transmission part of the transmission rod connects to the pushing element. As the transmission rod rotates, the pushing element is driven to push the claw to release the fixing state between the claw and the ratchet ring.

5 Claims, 5 Drawing Sheets

QUICK-TURN WRENCH

BACKGROUND OF THE INVENTION

1. Field of Invention

The invention relates to a wrench structure and, in particular, to the structure of a wrench whose wrench handle can be swiftly rotated with respect to the driving head.

2. Related Art

The conventional quick-turn wrench structure, as shown in FIG. 6, consists of a driving head 91 and a wrench handle 92 connected with each other. The driving head 91 has an axle hole 93 with an inner ratchet. The end of the wrench handle 92 connecting to the driving head 91 is formed with an axle base 94. The center of the axle base 94 and its two sides are formed with an accommodating groove 95, respectively, for accommodating a toggle 96 and an engaging tooth 97 to engage with the inner ratchet of the axle hole 93.

However, during the fabrication of the above-mentioned quick-turn wrench, the axle hole 93 of the driving head 91 has to be formed with the inner ratchet by additional machining. The axle base 94 with several accommodating grooves 95 also needs to be formed on the wrench handle 92. Therefore, the manufacturing is so complicated that production time and cost cannot be reduced. Moreover, since the axle base 94 of the wrench handle 92 to connect with the axle hole 93 is machined to form several accommodating grooves 95, the structural strength of the wrench handle 92 is thus reduced. Therefore, it cannot sustain a larger stress change in practice. The engaging tooth 97 is pushed by the toggle 96 to engage with the inner ratchet of the axle hole 93. The fixing effect of this mechanism is not ideal. Once the exerting force on the wrench becomes larger, the engaging tooth 97 cannot effectively engage with the inner ratchet of the axle hole 93.

SUMMARY OF THE INVENTION

An objective of the invention is to provide a quick-turn wrench that is simple in structure, easy to assemble, and cheap to make. Its operation is also simple and quick.

To achieve the above-mentioned objective, the disclosed quick-turn wrench includes: a driving head, a ratchet ring, a transmission rod, and a bottom plate.

One end of the driving head has an actuator, and the other end has an axle hole. One side of the inner wall of the axle hole has two claws disposed adjacent to each other.

The ratchet ring is accommodated in the axle hole. The ratchet ring has a connecting end extending upward and out of the axle hole, connecting to a wrench handle. The surrounding surface of the ratchet ring is formed with a ratchet part engaging the two claws.

The transmission rod is axially inserted into the ratchet ring to rotate with respect to the ratchet ring. One end of the transmission rod extends upward and penetrates through the connecting end of the ratchet ring, exposing itself outside the wrench handle. The other end is formed with a transmission part.

The bottom plate is disposed at the bottom of the axle hole. A sliding groove is formed on the end surface of the bottom plate that faces the interior of the axle hole. The sliding groove accommodates a pushing element corresponding to the two claws. The pushing element connects to the transmission part. Driven by the transmission part, the pushing element pushes the two claws to release their engagement with the ratchet ring.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
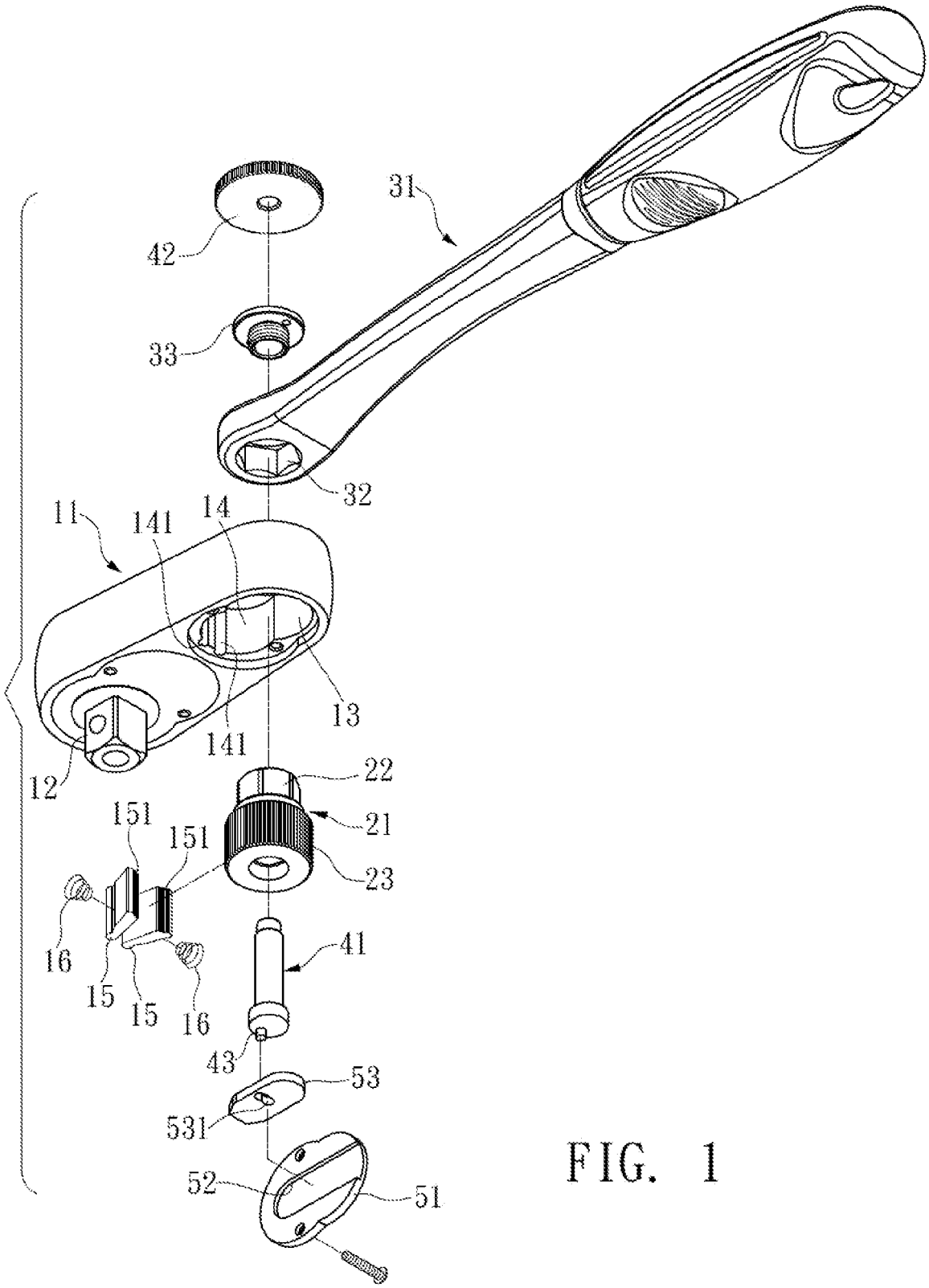
FIG. 1 is a three-dimensional exploded view of the invention.
Figure 2:
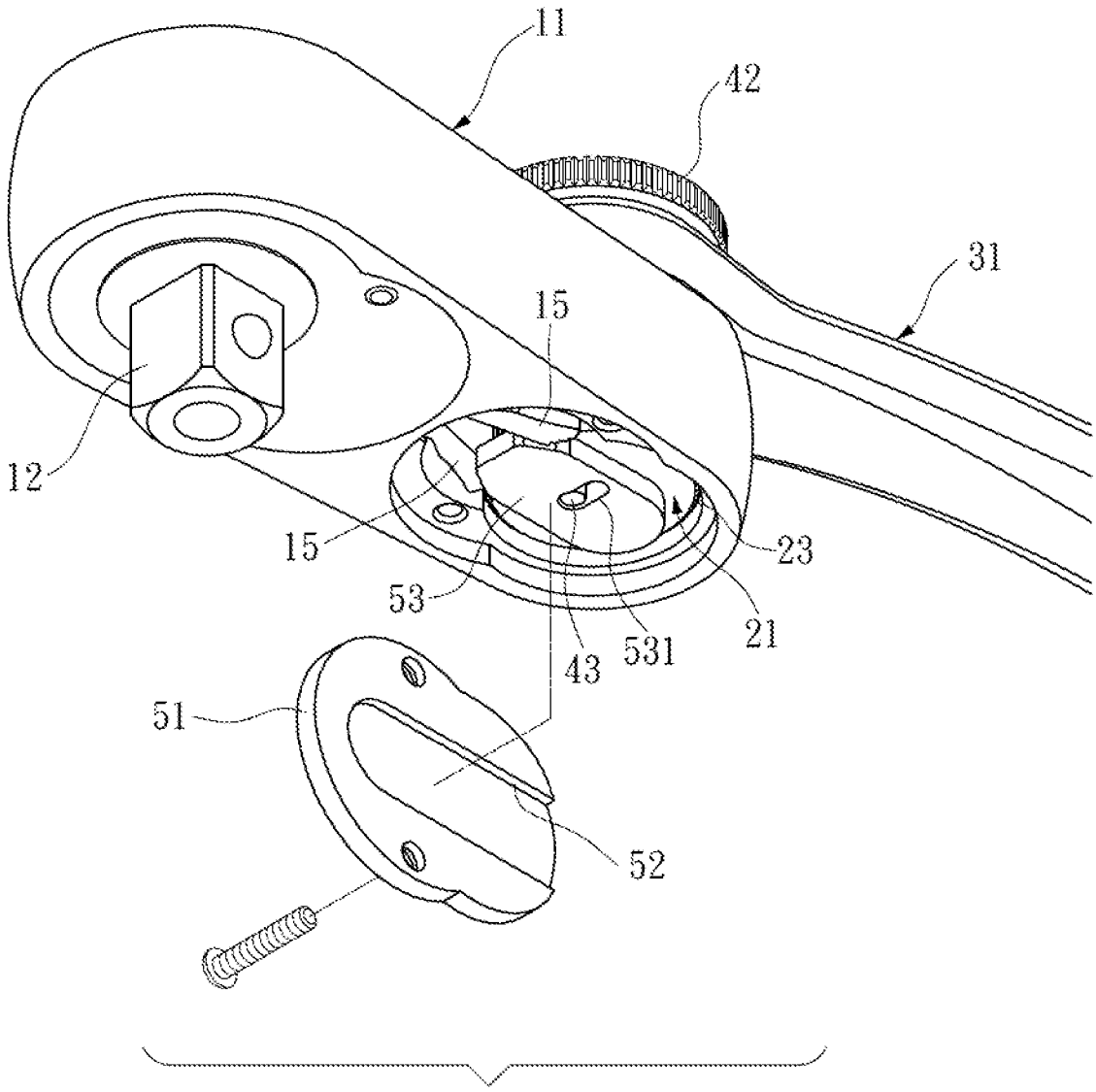
FIG. 2 is a schematic view of the invention after assembly.
Figure 3:
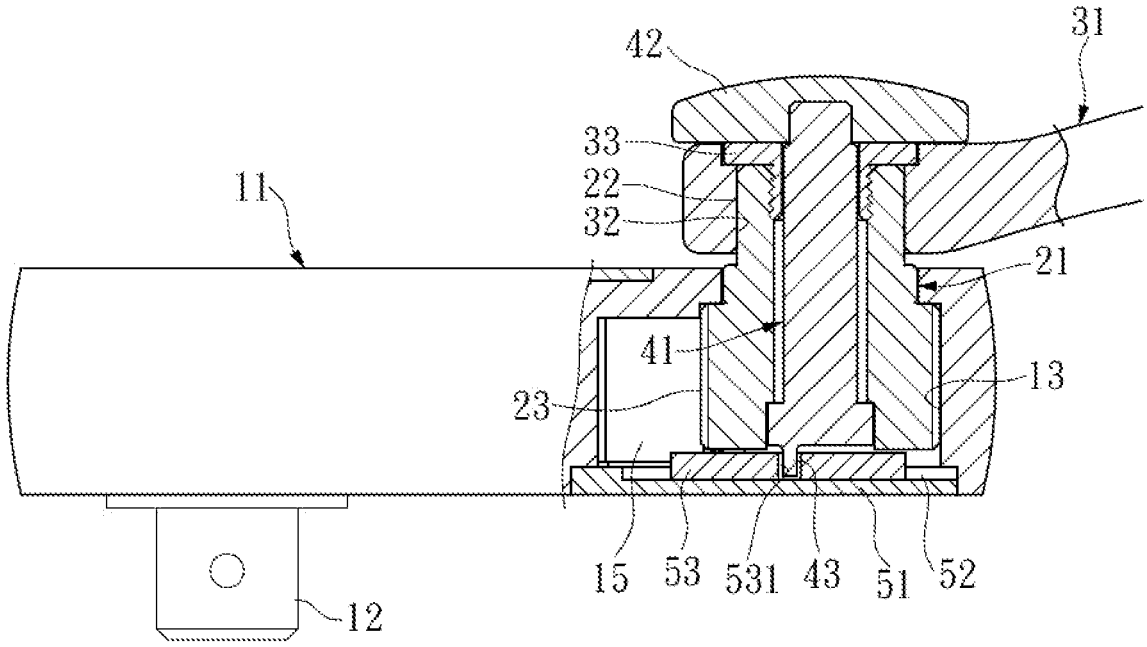
FIG. 3 is a cross-sectional view of the invention.

Please refer to FIGS. 1 to 3. The disclosed wrench includes a driving head 11, a ratchet ring 21, a wrench handle 31, a transmission rod 41, and a bottom plate 51.

One end of the driving head 11 has an actuator 12 for turning an object. The other end has an axle hole 13 along an axial direction. One side of the inner wall of the axle hole 13 is formed inward with an accommodating part 14. The accommodating-part 14 accommodates two claws 15 adjacent to each other. The two claws 15 are respectively urged by an elastic element 16 so that the two claws 15 exert a pinching force toward the axis of the axle hole 13. In this embodiment, the accommodating part 14 has two recesses 141. The two claws 15 are pivotally installed in the two recesses 141 by one end, respectively. The other ends of the two claws 15 are formed with engaging teeth 151 extending toward the axle hole 13. The two elastic elements 16 urge against the accommodating part 14 by one end. The other ends of the two elastic elements 16 urge against the sides of the corresponding claws 15 different from the engaging teeth 151. The two claws 15 can thus pinch toward the axis of the axle hole 13.

The ratchet ring 21 is a hollow ring accommodated in the axle hole 13. The ratchet ring 21 has a connecting end 22 extending upward. The connecting end 22 of the ratchet ring 21 is exposed upward and outside the axle hole 13. The surrounding surface of the ratchet ring 21 has a ratchet part 23. The two claws 15 are urged by the elastic elements 16 to engage with their engaging teeth 151 with the ratchet part 23 of the ratchet ring 21. The ratchet ring 21 is thus engaged and fixed.

One end of the wrench handle 31 is formed with a polygonal hole 32 corresponding to the connecting end 22 of the ratchet ring 21. The wrench handle 31 is mounted on the connecting end 22 of the ratchet ring 21 via the hole 32 thereof. A pressing ring 33 is inserted into the hole 32 and screw-fastened onto the connecting end 22. Therefore, the wrench handle 31 is connected with the ratchet ring so as to action together.

The transmission rod 41 is inserted axially into the ratchet ring 21 and can rotate with respect to the ratchet ring 21. The top end of the transmission rod 41 extends upward and penetrates through the connecting end 22 of the ratchet ring, exposing outside the wrench handle 31. The exposed top end of the transmission rod 41 is connected with a knob 42. When a user turns the knob 42, the transmission rod 41 is turned at the same time. The other end of the transmission rod 41 extends downward to form a transmission part 43. In this embodiment, the transmission part 43 is a protruding post slightly off the axis of the transmission rod 41.

The bottom plate 51 covers the bottom part of the axle hole 13. A sliding groove 52 is formed on the end surface of the bottom plate 51 that faces the interior of the axle hole 13. The sliding groove accommodates a pushing element 53 corresponding to the two claws 15. In this embodiment, the pushing element 53 has a transmission hole 531 whose diameter is larger than the outer diameter of the transmission part 43. The transmission part 43 of the transmission rod 51 penetrates into the transmission hole 531. When the user turns the knob 42 to rotate the transmission rod 41, the pushing element 53 in the sliding groove 52 toggles the inner wall of the transmission hole 531 in an eccentric swing through the transmission part 43 of the transmission rod 41. This action moves the pushing element 53 along the sliding groove 52 to push the two claws 15 releasing the engagement between the two claws 15 and the ratchet ring 21.

Figure 4:
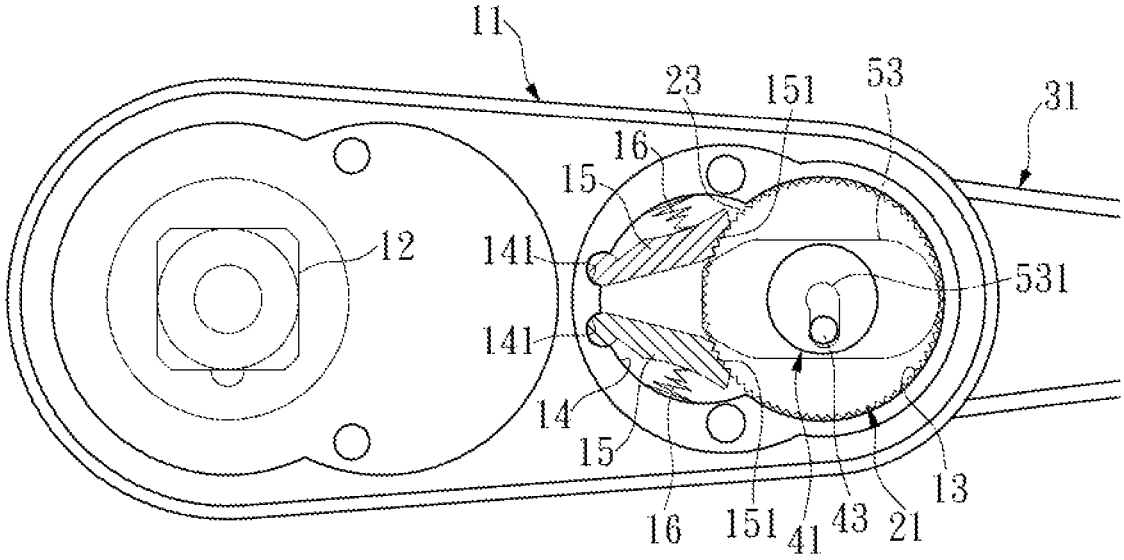
FIG. 4 is a schematic view of the invention in use, showing the situation when the claws and the ratchet ring are engaging each other.

Please refer to FIG. 4, which shows the engagement between the ratchet part 23 of the ratchet ring 21 and the engaging teeth 151 of the two claws 15. The two claws 15 are urged by the two elastic elements 16 to engage with the ratchet part 23 of the ratchet ring 21. The driving head 11 and the wrench handle 31 are fixed. In this state, the user can exert a larger force to turn the wrench.

Figure 5:
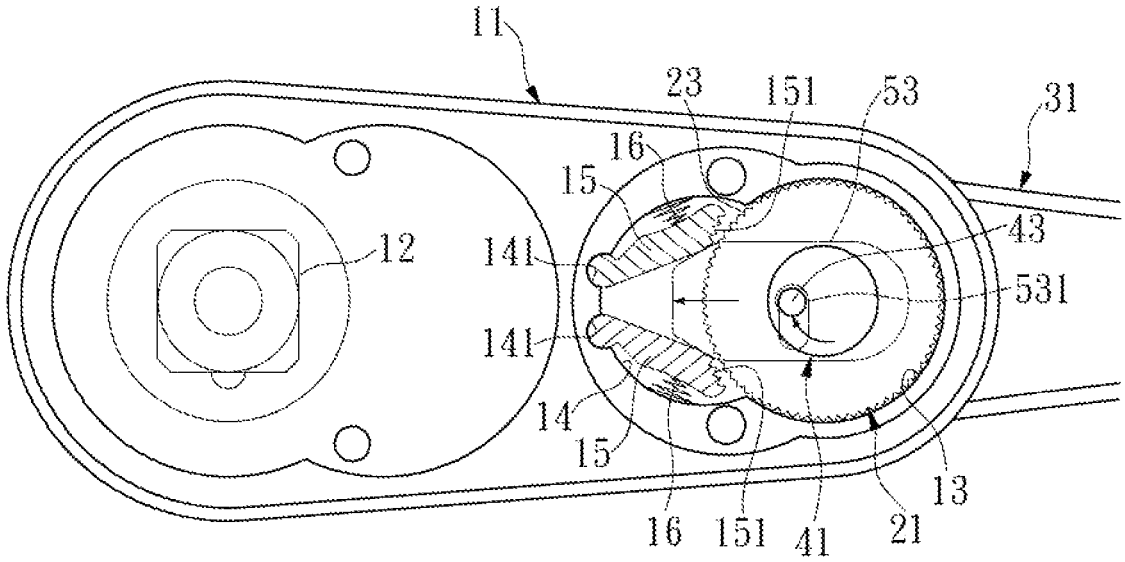
FIG. 5 is a schematic view of the invention in use, showing the situation when the claws and the ratchet ring release their engagement.
Figure 6:
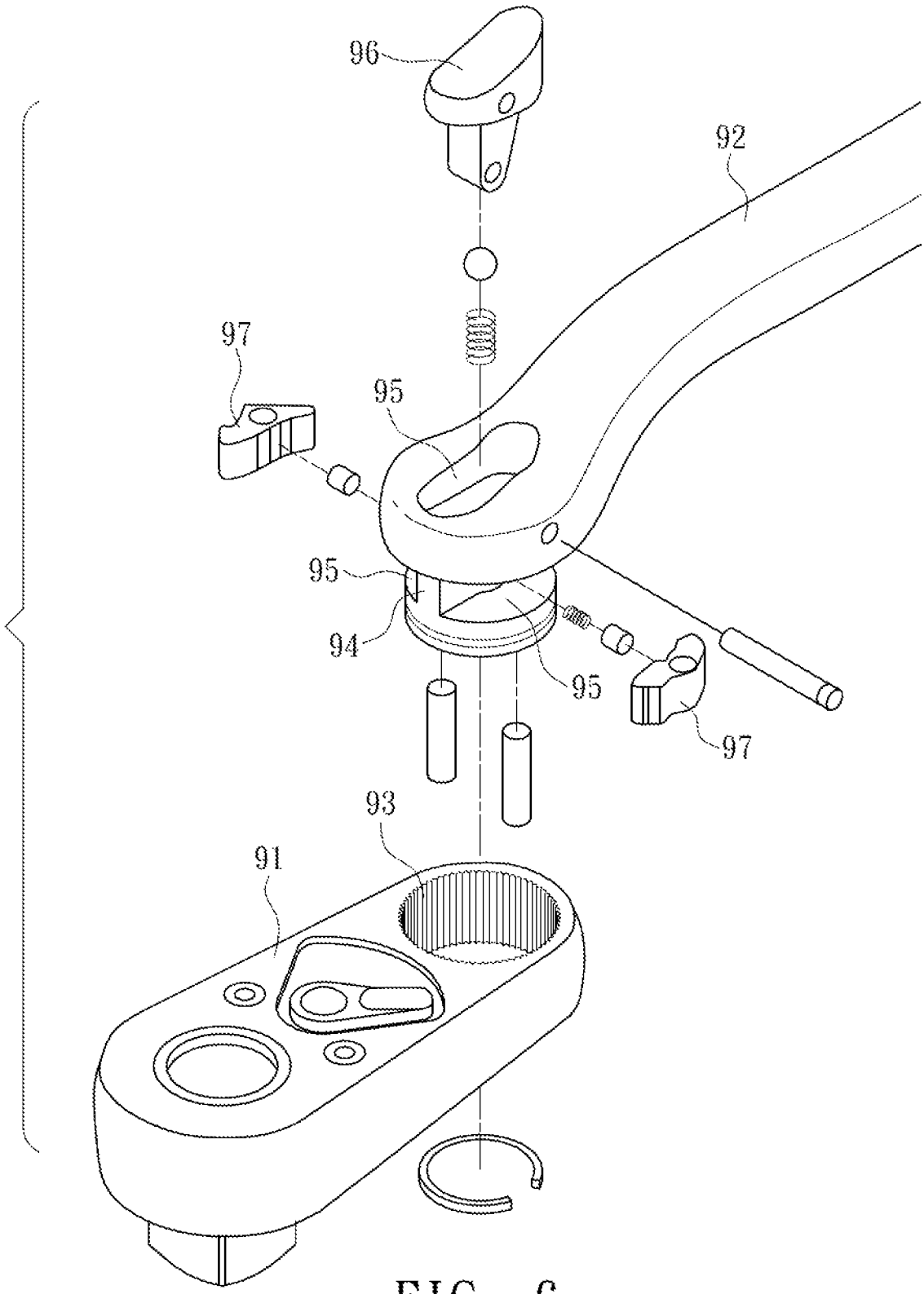
FIG. 6 PRIOR ART
FIG. 6 is a schematic view of a conventional quick-turn wrench.

When the user turns the knob 42 to rotate the transmission rod 41, as shown in FIG. 5, the pushing element 53 connects with the transmission part 43 that is off the axis of the transmission rod 41. Therefore, as the transmission part 43 rotates eccentrically with the transmission rod 41, the inner wall of the transmission hole 531 of the pushing element 53 is toggled to move the pushing element sideways along the sliding groove 52. This action pushes the two claws 15 to compress the two elastic elements 16, releasing the engagement between the engaging teeth 151 of the two claws 15 and the ratchet part 23 of the ratchet ring 21. Since the ratchet ring 21 is no longer fixed by the two claws 15 at this moment, the wrench handle 31 can swing with respect to the driving head 11 to make a quick turn.

When the user wants to restore the ratchet ring 21 back to the fixing state, he/she only needs to turn the knob 42 again. This makes the pushing element to slide backwards along the sliding groove, releasing the push on the two claws 15. The two claws 15, under the restoring force of the two elastic elements 16, reengage with the ratchet part 23 of the ratchet ring 21. The engaging and fixing state of FIG. 4 resumes.

According to the above description, the two claws 15 of the invention are urged by the two elastic elements 16 to directly engage the engaging teeth 151 with the ratchet part 23 of the ratchet ring 21. Therefore, the invention provides a better fixing effect. The disclosed wrench further has a simpler structure, while maintaining a better strength. It has the advantages of easier production and assembly and cheaper production cost. The operation of the invention is also fairly simple and quick.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A quick-turn wrench, characterized in that the wrench includes:

a driving head, whose one end has an actuator and whose other end has an axle hole, one side of the inner wall of the axle hole having two claws adjacent to each other and urged respectively by an elastic element to provide a pinching force toward the axis of the axle hole;

a ratchet ring accommodated in the axle hole and having a connecting end extending upward and outside the axle hole to connect and act with a wrench handle, the surrounding surface of the ratchet ring being formed with a ratchet part for engagement with the two claws for a fixing state;

a transmission rod inserted axially into the ratchet ring to rotate with respect to the ratchet ring, one end thereof extending upward and through the connecting end of the ratchet ring and exposing out of the wrench handle, and the other end thereof being formed downward with a transmission part; and a bottom plate disposed at the bottom of the axle hole, the end surface thereof facing the interior of the axle hole being formed with a sliding groove that accommodates a pushing element corresponding to the two claws and connected with the transmission part, wherein the pushing element is moved by the transmission part to push the claws, releasing the engagement between the claws and the ratchet ring.

2. The quick-turn wrench of claim 1, wherein one side of the inner wall of the axle hole is concavely formed with an accommodating part that is further formed with two recesses; the two claws are pivotally installed in the two recesses by one end, respectively; the other ends of the two claws are formed with engaging teeth extending toward the axis of the axle hole; one end of each of the elastic elements urges against the accommodating part and the other end urges against the side of corresponding claw different from the engaging tooth, so that the two claws pinch toward the axis of the axle hole.

3. The quick-turn wrench of claim 1, wherein the wrench handle has a polygonal hole corresponding to the shape of the connecting end of the ratchet ring; the wrench handle is mounted on the connecting end of the ratchet ring via the hole; a pressing ring is inserted into the hole to screw-fasten onto the connecting end, so that the wrench handle and the ratchet ring are connected to action together.

4. The quick-turn wrench of claim 1, wherein the end of the transmission rod exposed from the wrench handle is connected with a knob; and as a user turns the knob, the transmission rod is driven to rotate.

5. The quick-turn wrench of claim 1, wherein the transmission part is a protruding post slightly off the axis of the transmission rod; the pushing element is formed with a transmission hole whose diameter is larger than the outer diameter of the transmission part; the transmission part of the transmission rod is inserted into the transmission hole; when the transmission rod rotates and the transmission part of the transmission rod toggles the inner wall of the transmission hole in an eccentric swing, the pushing element in the sliding groove is moved along the sliding groove to push the two claws, releasing the engagement between the two claws and the ratchet ring.

* * * * *